US006863511B2

(12) United States Patent
Kriehn et al.

(10) Patent No.: US 6,863,511 B2
(45) Date of Patent: Mar. 8, 2005

(54) TWO-SHAFT VACUUM PUMP

(75) Inventors: Hartmut Kriehn, Köln (DE); Lothar Brenner, Bad Münstereifel (DE); Manfred Behling, Köln (DE); Thomas Dreifert, Kerpen (DE); Klaus Rofall, Rösrath (DE); Heinrich Englander, Linnich (DE); Michael Froitzheim, Dormagen (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/343,958

(22) PCT Filed: Jul. 6, 2001

(86) PCT No.: PCT/EP01/07739

§ 371 (c)(1),
(2), (4) Date: Feb. 5, 2003

(87) PCT Pub. No.: WO02/12726

PCT Pub. Date: Feb. 14, 2002

(65) Prior Publication Data

US 2004/0091380 A1 May 13, 2004

(30) Foreign Application Priority Data

Aug. 10, 2000 (DE) ..... 100 39 006

(51) Int. Cl.[7] ..... F04C 18/16; F04C 29/04
(52) U.S. Cl. ..... 418/201.1; 418/94; 418/179
(58) Field of Search ..... 418/94, 179, 201.1, 418/206.1, 206.3

(56) References Cited

U.S. PATENT DOCUMENTS

| | | | | |
|---|---|---|---|---|
| 4,747,763 A | | 5/1988 | Sibata et al. | 418/206.2 |
| 4,971,536 A | | 11/1990 | Takeda et al. | 418/206.5 |
| 5,158,390 A | | 10/1992 | Ito et al. | 403/282 |
| 5,226,791 A | * | 7/1993 | Miwa et al. | 418/179 |
| 5,295,788 A | | 3/1994 | Tajima et al. | 416/204 R |
| 5,846,062 A | * | 12/1998 | Yanagisawa et al. | 417/410.4 |
| 5,924,855 A | | 7/1999 | Dahmlos et al. | 418/91 |
| 6,382,930 B1 | | 5/2002 | Bahnen et al. | 417/310 |
| 6,497,563 B1 | | 12/2002 | Steffens | 418/88 |

FOREIGN PATENT DOCUMENTS

| | | | | |
|---|---|---|---|---|
| DE | 413237 | | 5/1925 | |
| DE | 972862 | | 10/1959 | |
| DE | 3124247 C1 | | 6/1983 | |
| DE | 3813272 C2 | | 6/1990 | |
| DE | 3810498 C2 | | 3/1996 | |
| DE | 19522558 A1 | | 1/1997 | |
| DE | 19522559 A1 | | 1/1997 | |
| DE | 19817351 | | 10/1999 | |
| DE | 19820523 A1 | | 11/1999 | |
| DE | 19839501 A1 | | 3/2000 | |
| DE | 19963171 A1 | | 6/2001 | |
| FR | 1290239 | | 3/1962 | |
| JP | 64-66488 | * | 3/1989 | 418/179 |
| JP | 03213688 | | 9/1991 | 418/201.1 |
| JP | 07009111 | | 1/1995 | |
| JP | 8261183 | | 10/1996 | |
| WO | WO 99/19631 | | 4/1999 | |
| WO | WO 01/48384 A1 | | 7/2001 | |
| WO | WO 02/12726 | | 2/2002 | |

* cited by examiner

*Primary Examiner*—John J. Vrablik
(74) *Attorney, Agent, or Firm*—Fay, Sharpe, Fagan, Minnich & McKee, LLP

(57) ABSTRACT

A vacuum pump has two shafts (3, 4) and two rotors (1, 2) which co-operate with each other and which are fixed to the shafts. The rotors are cantilevered on the shafts. The rotors are fixed to the shafts in a manner which is devoid of backlash, even during temperature changes. In order to achieve this, the shafts (3, 4) are made of a material having a modulus of elasticity which is as high as possible, e.g., steel. The rotors (1, 2) are made of a material having a density which is as low as possible, e.g., aluminum or a titanium alloy. Structures (8; 11, 12, 13; 14, 15; 25, 27; 38, 41; 43, 44, 45; etc.) are provided to ensure that the rotors (1, 2) are fixed to the shafts (3, 4) in a manner which is devoid of backlash at all operating temperatures.

18 Claims, 2 Drawing Sheets

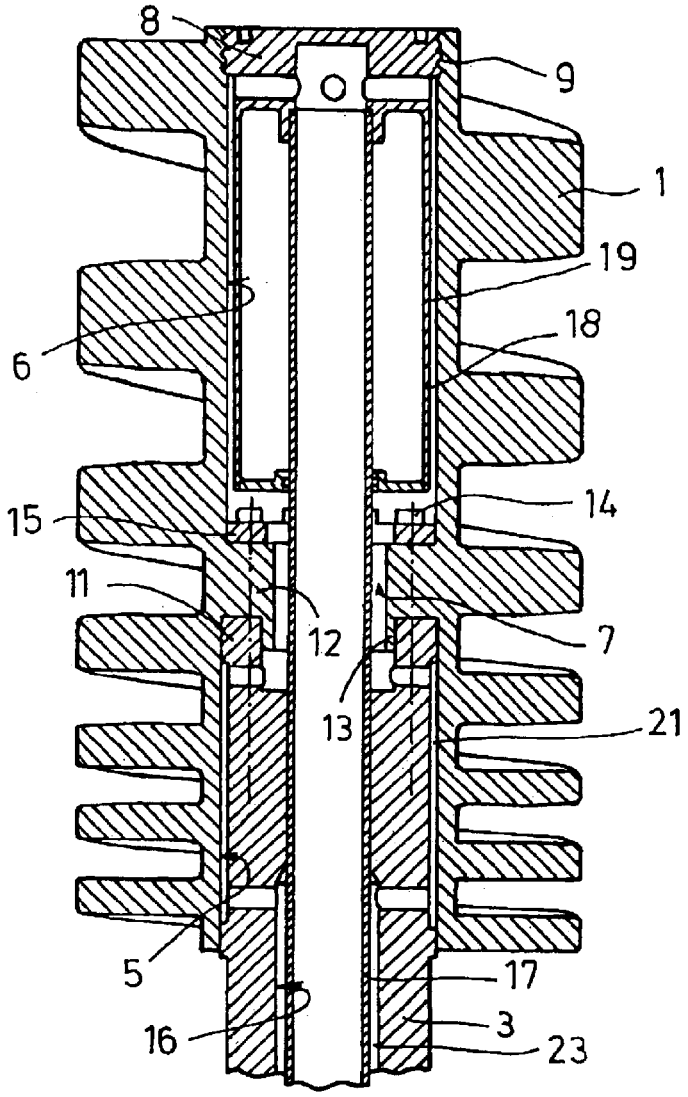
FIG.1
FIG.2
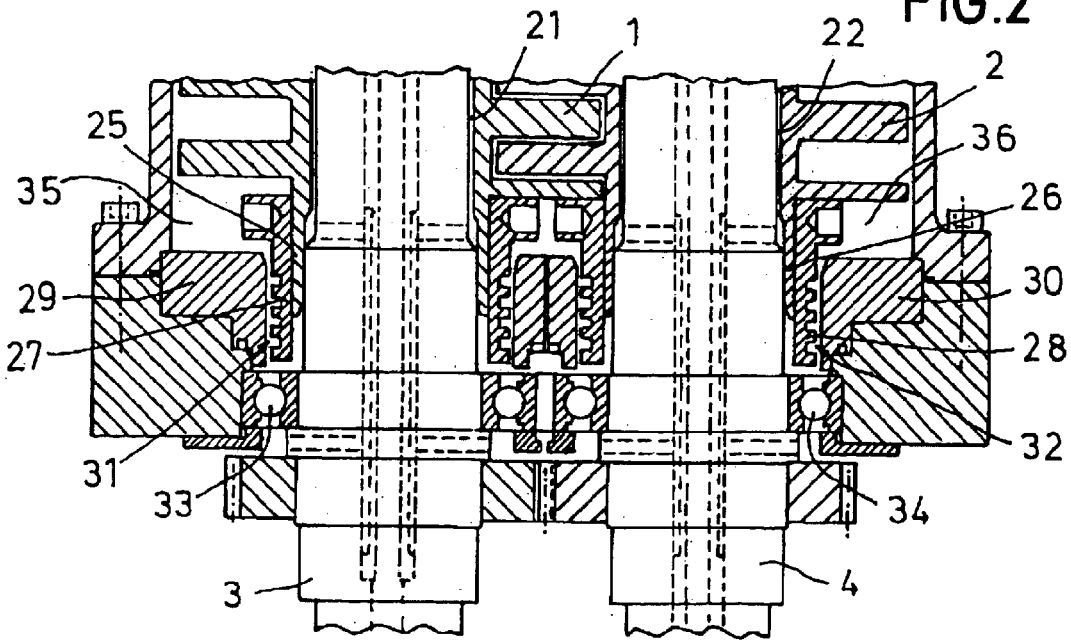

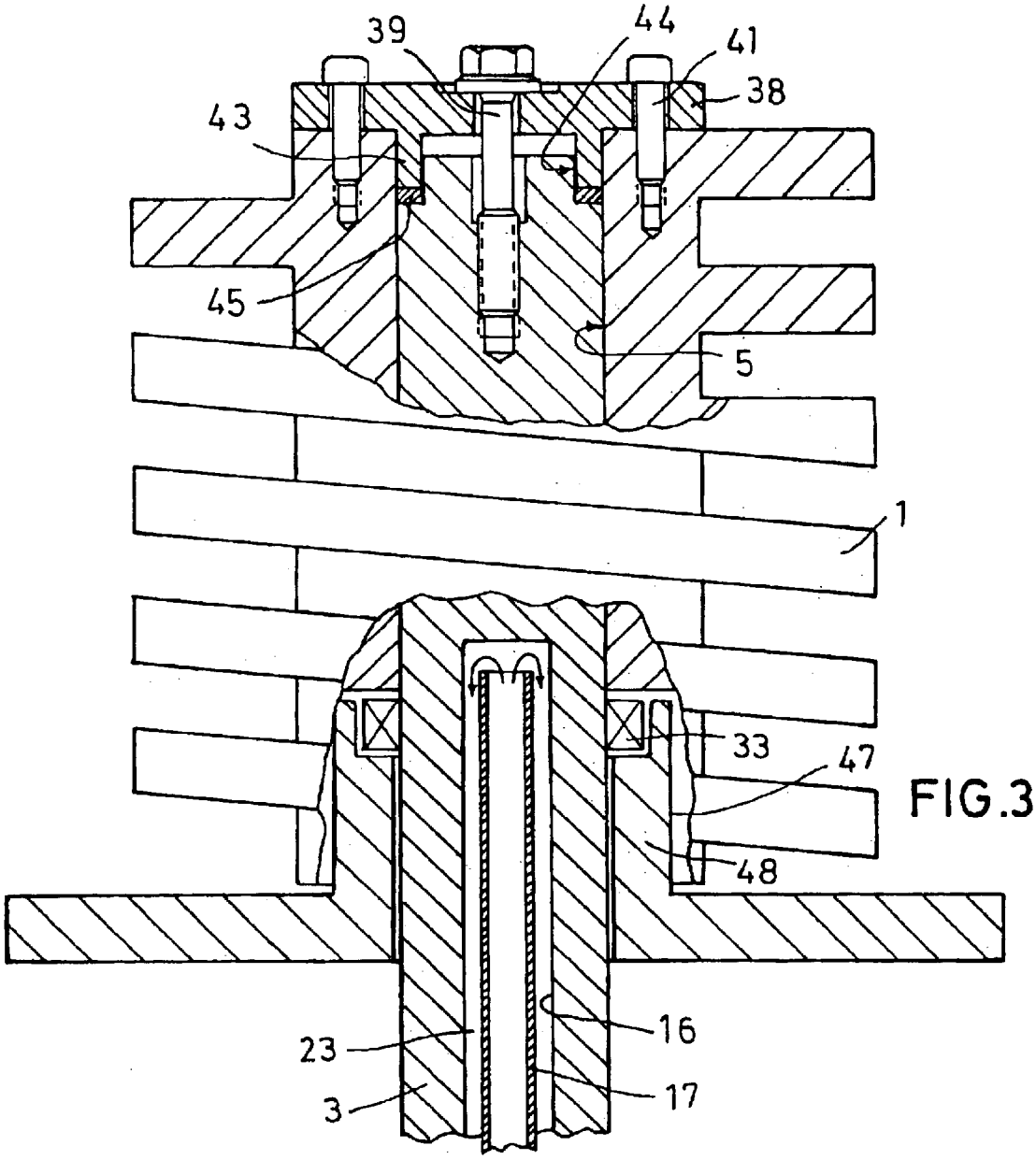
FIG.3
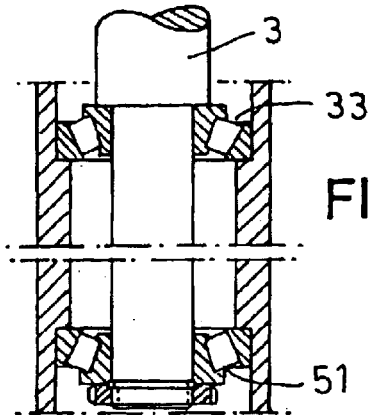
FIG.4
FIG.5
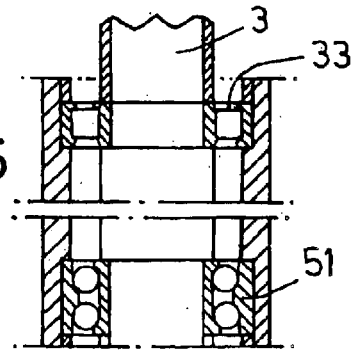

TWO-SHAFT VACUUM PUMP

The present invention relates to a vacuum pump comprising two shafts and two rotors which co-operate with each other and which are fixed to the shafts. In this manner, the rotors are cantilevered by the shafts.

The developers and manufacturers of prior pumps, screw pumps in particular, want to operate such pumps at reasonable manufacturing costs at as high as possible speeds, and with leaks through slots as small as possible, in order to attain the purpose—vacuum generation—as effectively as possible. The pre-requisites for this are precise bearings and fitting of the rotors to the shafts devoid of backlash—also in the warm state. As to the bearing, it needs to be considered that the rotors are cantilevered. This is commonly performed two bearings per shaft between which there is located a drive motor. In particular, in the instance of screw vacuum pumps such a kind of bearing has been found to be expedient, since its benefits—no seal on the intake side, more cost-effective compared two double-flow solutions—are greater than the disadvantages—higher requirements as to shaft and bearing.

The cantilevered arrangement is the cause for problems relating to affixing of the rotors to their shafts devoid of backlash. It is known that in the instance of a cantilevered arrangement it is expedient that the center of gravity of the rotating system be located in the vicinity of the bearing on the rotor side. This can be achieved in that a material being as light in weight as possible, aluminium for example, is selected for the rotor. However, aluminium has a significantly greater coefficient of thermal expansion (about $23\times10^{-6}$/K) compared to steel ($12\times10^{-6}$/K) which in the case of cantilevered arrangements is specially well suited as the material for the shaft. Steel has a high modulus of elasticity thus enabling the manufacture of stiff shafts. In the instance of the material pair steel/aluminium it is difficult to affix the rotor to the shaft devoid of backlash at all operating temperatures (between ambient temperature and approximately 200° C.). There exists, in fact, the possibility of employing as to the expansion problem more favourable materials like steel, Ti or ceramics for the rotor. However, these result in rotors being too heavy (St) or too expensive (Ti, ceramics). Also aluminium is not a possibility for the shaft material owing to its low modulus of elasticity.

From DE-199 63 171 A1 a vacuum pump having the aforementioned characteristics is known. Affixing of the rotor to the shaft devoid of backlash in the warm state is not covered.

It is the task of the present invention to create a vacuum pump having the aforementioned characteristics which will optimally fulfil the aims of the manufacturers and developers of such vacuum pumps.

SUMMARY OF THE INVENTION

This task is solved through the characterizing measures of the patent claims.

In that the shafts are made of a material having a modulus of elasticity which is as high as possible (steel, for example), precise guidance of the shafts and thus the rotors is ensured so that the slots between the rotors themselves and the housing walls can be kept small. Also the means which ensure affixing of the rotors to the shafts devoid of backlash have this effect. Lighter rotor materials compared to the material for the shaft will allow the pump to be operated at high rotational speeds.

The means of ensuring fixing of the rotors to their shafts devoid of backlash at all operating temperatures may be implemented differently. In the instance of greater differences between the coefficients of expansion of the materials involved, the rotors and the shafts may be designed in such a manner that the freedom from backlash is ensured through warm centering, cold centering and/or friction centering. Also bindings preventing a greater expansion of the aluminium rotor on the steel shaft are possible. Finally—supported or alone—a cooling arrangement may be present which restricts or prevents temperature fluctuations at the joints.

As already mentioned, it would be simple to employ materials having approximately the same coefficient of expansion. To this end the inventors have proposed to employ aluminium alloys manufactured based on powder metallurgy, the principal components of which are Cu and Si in the alloy. Steel and aluminium alloys of this kind have approximately the same coefficient of expansion (density of the material—mass) so that through shrink joints of the type commonly employed, fixing of the rotors to the shafts devoid of backlash at all operating temperatures is ensured.

In order to succeed in placing the center of gravity of the systems each consisting of a rotor and a shaft, as close as possible to the bearing on the rotor side for the purpose of attaining high speeds several measures can be expedient:

- Hollow bore in the rotor, into which the steel shaft engages only partly; if required for the purpose of guiding a coolant fluid, components having a low density (plastics, for example) can be accommodated in the bore.
- Short rotors; this is achieved in screw pumps in a basically known manner through a suitable change in pitch and/or through deeply cut-in rotor profiles.
- Accommodation of the shaft bearing on the rotor side in a recess on the bearing side within the rotor.
- O-arrangement of the two shaft bearings and/or movable bearings at the rotor side, and fixed bearings at the side of the shaft facing away from the rotor.

Still further advantages will be apparent to those of ordinary skill in the art upon reading and understanding the following detailed description.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 1 is a longitudinal sectional view of a single rotor and shaft combination;

FIG. 2 is a longitudinal transverse view of a pair of shaft and rotor combinations in an intermeshing relationship mounted to associated support structure;

FIG. 3 is a side view in partial section of an alternate embodiment of the rotor shaft combination;

FIG. 4 is a longitudinal sectional view illustrating one embodiment of bearings for supporting the rotor shaft; and FIG. 5 is a longitudinal sectional view illustrating an alternate bearing embodiment.

DETAILED DESCRIPTION OF THE PREFERRED EMBODIMENTS

In the drawing figures the rotors are designated as 1 (resp. 1 and 2 in drawing FIG. 2) and their shafts as 3 (resp. 3, 4). The rotors are cantilevered and equipped with axial hollow bores into which the bare ends of the shafts 3, 4 extend. The rotors 1, 2 are each fixed on to the shaft ends devoid of backlash.

In the example of an embodiment in accordance with drawing FIG. 1 the rotor 1 has on its face sides two hollow bores 5 and 6 which are linked to each other approximately at the center of the rotor 1 via a more narrow bore 7. In the assembled state, the opening of the hollow bore 6 on the intake side is firmly sealed with a disk 8, which is—as depicted—screwed into the hollow bore with the aid of a thread 9, for example.

In the hollow bore 5 on the bearing side there already ends the shaft 3 which is equipped on its face side with an axially oriented collar 11. In the area of the more narrow bore 7 linking the hollow bores 5 and 6, the annular protrusion 12 extending to the inside is equipped with an axially oriented collar 13, the direction and diameter of which are so selected that it rests from the inside against the collar 11 of the shaft 3. If the shaft 3 is made of steel and the rotor 1 of aluminum having, compared to steel, a greater coefficient of expansion and if the collars 11, 13 rest against each other at ambient temperature devoid of backlash, there results an inner centering which remains devoid of backlash also at higher temperatures.

For the purpose of joining rotor 1 and shaft 3 there are provided axial bolts 14 which are accessible from the hollow bore 6. These penetrate the protrusion 12 of the rotor 1 and are screwed into the collar 11 of the shaft.

Expediently, a ring 15 made of the same material as the shaft is assigned to the heads of the bolts. Thus there results besides warm centering also friction centering.

Moreover, shaft 3 and rotor 1 are equipped with a system of cooling channels for the purpose of reducing temperature related problems. To this end the shaft 3 is equipped with a central bore 16. Located in this bore 16 is a pipe section 17 which extends into the hollow bore 6 and which serves the purpose of feeding in a coolant. Within the hollow bore 6, hollow (thin walled) and/or light installations 18 affixed to pipe section 17 form an outer annular channel 19, which among other things, is linked via the bore 7 to an outer annular channel 21 in the hollow bore 5 formed by the shaft 3 and the inner wall of the hollow bore 5. Via these annular channels 19, 21 and thereafter via the annular channel 23 in the shaft being provided by pipe section 17 and the inner wall of the bore 16, the coolant flows back. A reverse direction for the coolant flow may also make sense.

In drawing FIG. 2 the rotors 1, 2 are equipped on the bearing side with collars 25, 26, said collars encompassing the shafts 3, 4 from the outside. If the rotor material has a greater coefficient of expansion than the shafts, backlashes may be present between rotors and shaft when the temperatures increase in the instance of outer centering of this kind. In order to avoid this, rings 27, 28 are provided which in turn encompass the collars 25, 26. If the coefficient of expansion of the materials for the rings 27, 28 is equal or even smaller than the coefficient of expansion of the material for the shaft, rings 27, 28 will at increasing temperatures prevent an expansion of the collars 25, 26 and thus the undesirable backlashes.

A cooling system in accordance with the cooling system of drawing FIG. 1 is provided. The annular channels 21, 22 extend up into the areas of the collars 25, 26. Said annular channels reduce the maximum operating temperatures which may occur and thus equally remove the risk of backlashes.

From the outside the rings 27, 28 are equipped with annular grooves in which piston rings which are not depicted, are located. These form jointly with the rings 29, 30 affixed to the housing, labyrinth seals 31, 32 which serve the purpose of preventing the ingress of lubricant vapours from the bearings 33, 34 into the pump chambers 35, 36 of the screw pump.

In the example of an embodiment in accordance with drawing FIG. 3, frictional centering has been implemented. To this end a disk 38 is provided which initially has the task of sealing off the opening of the hollow bore 5 on the intake side. The disk 38 is firmly joined to both the shaft 3 (bolt 39) and also the rotor (several bolts 41). If the rotor material has a greater coefficient of expansion compared to shaft 3 and if the disk 38 consists, for example, of the shaft material, then the fixed bolted joint will prevent the formation of backlash at increasing temperatures.

As depicted in drawing FIG. 3 the disk 38 may be equipped with an axially oriented collar 43 which engages into the hollow bore 5. Thus at the same time warm centering can be attained. To this end, it is required that rotor 1, shaft 3 and disk 38 be fitted without backlash in the warm state. Due to the already mentioned conditions with respect to the coefficients of expansion, this type of mounting is devoid of backlash at decreasing temperatures. This also applies to fixing of the rotor/shaft without disk 38.

Fixing of the rotor to the shaft may also be effected by means of a press fit joint. If the rotor consists of aluminium and the shaft of steel, then it is in this instance expedient that the ambient temperature at which this press fit joint is manufactured, corresponds approximately to the maximum temperature encountered by the rotors (1, 2) which occurs during operation of the two-shaft vacuum pump.

A joint of this kind is devoid of backlash at all occurring operating temperatures of the two-shaft vacuum pump.

Also depicted in drawing FIG. 3 is that the collar 43 and the face side of the shaft 3 rest against each other, preferably within an outer recess 44 in the shaft 3. Located between the facing supporting surfaces of collar 43 and shaft 3 is an adjusting ring 45. By inserting adjusting rings 45 differing in thickness—or through collars 43 differing in height—the axial position of the rotor 1 with respect to shaft 3 can be defined. Thus there exists the possibility of adjusting flank-to-flank backlash of the rotor 1 with respect to the second rotor not depicted. Disk 38 may simultaneously serve the purpose of balancing and/or torque transfer (by way of a tooth lock washer, for example).

Finally depicted in drawing FIG. 3 is the possibility of arranging the bearing 33 on the rotor side in a recess 47 at the bearing side in rotor 3. An axially extending bearing support 48 engages into the recess 47. The system of cooling channels (bore 16 in the shaft 3, pipe section 17) extends up to bearing 33 so as to maintain the bearing temperatures at a low level.

In order to reliably attain the desired high speeds it is expedient that the two shaft bearings 33, 51 have an O type arrangement as depicted in drawing FIG. 4. In bearings of this kind the point of application of the force is shifted by the pressure angle in the direction of the rotor's center of gravity. In view of this, also a movable bearing 33 at the rotor side and a fixed bearing 51 at the side of shaft 3 facing away from the rotor is expedient. Drawing FIG. 5 depicts this arrangement. The point of application of the force is at the bearing center.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A vacuum pump including:

two steel shafts;

two aluminum rotors, each having a hollow bore;

a tight friction joint formed between each of the shafts and a corresponding rotor by press fitting the shaft into the corresponding rotor bore with the rotor heated at least to a maximum operating temperature attainable during vacuum pumping such that the aluminum rotors are fixed to the steel shafts in a manner which is devoid of backlash at all operating temperatures;

a cooling means disposed at a level at which the shaft and the rotor are joined; and the shafts being rotatably mounted with the rotors cantilevered on the shafts and co-operating with each other.

2. The pump according to claim 1, wherein the rotors are made of aluminum alloy manufactured based on powder metallurgy, components of which alloy include Cu and Si.

3. A vacuum pump comprising:

two steel shafts;

two aluminum rotors which co-operate with each other and which are fixed to the shafts, the rotors being cantilevered on the shafts;

a cooling means disposed at a level at which the rotors and shafts are joined; and, a means for insuring that the rotors are fixed to the shafts in a manner which is devoid of backlash at all operating temperatures, including a tight frictional joint formed by:

drilling a hollow bore in each of the aluminum rotors;

heating each of the rotors to a maximum operating temperature which the rotors attain during vacuum pumping;

inserting a corresponding one of the steel shafts into the hollow bore of each rotor; and press fitting each of the rotors heated to the maximum operating temperature and the corresponding shaft into the tight frictional joint.

4. The pump according to claim 3, wherein the rotor is equipped with a collar which encompasses the shaft and further including:

a binding which encompasses the collar.

5. The pump according to claim 3, further including:

a rotor side bearing located in a recess in the rotor.

6. The pump according to claim 3, further including:

two bearings mounted on each shaft with an O type arrangement.

7. The pump according to claim 3 further including:

a movable bearing adjacent to the rotor; and a fixed bearing remote from the rotor.

8. The pump according to claim 3, further including:

a disk arranged on an intake side of the rotor.

9. The pump according to claim 8, wherein the disk is equipped with a collar engaging into the hollow bore of the rotor, said disk effecting cold centering.

10. The pump according to claim 3, wherein the cooling means includes a hollow interior space defined in the rotor bore and the shaft only partly penetrating the hollow space.

11. The pump according to claim 10 further including:

light-weight components disposed in the hollow space between the shaft and the rotor to guide a coolant flow.

12. A vacuum pump comprising:

two shafts;

two rotors which co-operate with each other and which are fixed to the shafts, the rotors being cantilevered on the shafts, having hollow bores, and being of a material having a lower density than the shafts; and, a disk arranged on an intake side of each rotors, each disk being equipped with a collar engaging into a hollow bore of a corresponding one of the rotors, said disk effecting cold centering;

the collar and the shaft resting against each other directly and through an adjusting ring;

a means for insuring that the rotors are fixed to the shafts in a manner which is devoid of backlash at all operating temperatures.

13. The pump according to claim 12, further including:

a means for at least one of cold centering, warm centering and friction centering the rotor on its shaft.

14. The pump according to claim 13, wherein the means for warm centering includes:

axially extending collar sections of the rotor relative to the shaft, the collar section of the rotor being located inside the rotor.

15. The pump according to claim 13, wherein the means for friction centering includes:

axially oriented bolts which join the rotor and the shaft to each other.

16. A vacuum pump comprising:

a pair of steel shafts;

a plurality of bearings which support the shafts in a parallel relationship, the bearings being mounted adjacent a first end of the shafts such that second ends of the shafts are cantilevered;

a pair of aluminum rotors which have a different coefficient of thermal expansion than the shafts, each of the rotors having an internal bore, a second end of each of the shafts being received in one of the bores to support the rotors in an intermeshing relationship with each other;

a means for inhibiting backlash at elevated operating temperatures including:

each shaft press fit into the bore of one of the rotors when the rotor was heated to at least a maximum operating temperature to form a tight frictional engagement at temperatures at and below the maximum operating temperature, a cooling passage extending through each shaft to a region in which the shaft and rotor are in tight frictional engagement to limit temperature in the region of tight frictional engagement during vacuum pumping.

17. A vacuum pump comprising:

a pair of shafts;

a plurality of bearings which support the shafts in a parallel relationship, the bearings being mounted adjacent a first end of the shafts such that second ends of the shafts are cantilevered;

a pair of rotors of a lower density material than the shafts and which has a different coefficient of thermal expansion than the shafts, each of the rotors having an internal bore, a second end of each of the shafts being received in one of the bores to support the rotors in an intermeshing relationship with each other;

a means for inhibiting backlash at elevated operating temperatures including at least one of:

a flange defined on an interior surface of each rotor extending into the bore parallel to the shafts with an axially extending collar section of each shaft press fit between the flange and a wall surface of the bore in a tight frictional engagement at the operating temperature, an inward projecting collar section of the rotor and axially oriented bolts extending through the collar section and threadedly received in the shaft, a disk frictionally engaged in each bore and attached to the rotor which is received in the bore, a disk mounted on an intake side of each rotor and anchored to the shaft and to the rotor, a disk with a collar which collar is press fit at the elevated operating temperature into engagement with the bore of the rotor with the collar engaging the shaft, a collar defined on one end of the rotor and a peripheral binding which surrounds the rotor collar, the binding having a coefficient of thermal expansion that is comparable with the coefficient of thermal expansion of the shaft, at least one region of firm frictional engagement between an outer surface of each shaft and an inner surface of each rotor bore with a cooling duct extending through the shaft therepast to cool the frictionally engaging portions of the shaft and rotor, at least one ring of material with the same coefficient of thermal expansion as the shaft mounted in each rotor bore, a disk with the same coefficient of thermal expansion as the shaft anchored to each rotor to limit outward radial thermal expansion of each rotor.

18. The vacuum pump according to claim 17 wherein the shaft is made of steel and the rotor is made of a light weight alloy including at least one of aluminum, titanium, and ceramics.

* * * * *